US008626447B2

(12) United States Patent
Liu

(10) Patent No.: US 8,626,447 B2
(45) Date of Patent: Jan. 7, 2014

(54) SYSTEM AND METHOD FOR SWEET ZONE IDENTIFICATION IN SHALE GAS RESERVOIRS

(75) Inventor: Chengbing Liu, Katy, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 580 days.

(21) Appl. No.: 12/880,436

(22) Filed: Sep. 13, 2010

(65) Prior Publication Data

US 2012/0065887 A1 Mar. 15, 2012

(51) Int. Cl.

| | |
|---|---|
| ***G01V 5/04*** | (2006.01) |
| ***G01V 5/00*** | (2006.01) |
| ***G01N 15/08*** | (2006.01) |

(52) U.S. Cl.

USPC ..... 702/8; 702/6; 702/13

(58) Field of Classification Search

USPC ..... 702/5, 6, 11, 13, 33, 179; 367/14, 21, 367/25, 26; 703/10; 175/40, 50; 166/250.01; 324/323, 326

See application file for complete search history.

(56) References Cited

U.S. PATENT DOCUMENTS

| | | | | |
|---|---|---|---|---|
| 3,638,484 | A | 2/1972 | Tixier | |
| 4,686,364 | A | 8/1987 | Herron | |
| 4,916,616 | A | 4/1990 | Freedman et al. | |
| 6,832,158 | B2 * | 12/2004 | Mese et al. | 702/9 |
| 7,587,373 | B2 * | 9/2009 | Smith et al. | 706/16 |
| 2003/0070480 | A1 | 4/2003 | Herron et al. | |
| 2004/0099804 | A1 | 5/2004 | Liu et al. | |
| 2004/0140801 | A1 | 7/2004 | Schoen et al. | |
| 2008/0114547 | A1 | 5/2008 | Syngaevsky | |
| 2008/0154509 | A1 | 6/2008 | Heaton | |
| 2009/0254283 | A1 | 10/2009 | Jacobi et al. | |

FOREIGN PATENT DOCUMENTS

| | | |
|---|---|---|
| WO | WO2009015252 | 1/2009 |

OTHER PUBLICATIONS

PCT International Search Report dated Feb. 27, 2012.

Ghorab et al., The Relation Between the Shale Origin (Source or non Source) and its Type forAbu Roash Formation at Wadi El- Natrun Area South of Western Desert, Egypt, Egyptian Petroleum Research Institute, Cairo, Egypt 2008.

(Continued)

*Primary Examiner* — Marc Armand
*Assistant Examiner* — Ricky Ngon
(74) *Attorney, Agent, or Firm* — Carlos Hanze; Albert Shung

(57) ABSTRACT

A computer system and computer implemented method for automatically identifying a hydrocarbon (such as kerogen, gas, oil) rich zone in a well bore includes obtaining well log data comprising neutron data, density data, radioactivity data, and resistivity data representative of physical characteristics of a formation surrounding the well bore and computing an apparent neutron porosity and an apparent density porosity based on the neutron data and density data. A normalized neutron-density separation is computed based on the computed apparent neutron porosity and the computed apparent density porosity and a baseline of the formation is determined for each data type. Using the computed normalized neutron-density separation, the radioactivity data, the resistivity data, and the determined baselines, the presence or absence of a hydrocarbon rich zone is determined. A quality index may further be derived from the data.

13 Claims, 2 Drawing Sheets

(56) References Cited

OTHER PUBLICATIONS

Shagar, Intervals in the Gulf of Suez Area,Egypt, 2006.
Passey et al., A practical Model for Organic Richness from Porosity and Resistivity Logs, Dec. 1990.
Aly et al., Resistivity, Radioactivity and Porosity Logs as Tools to Evaluate the Organic Content of ABU Roash "F" and "G" Members, North Western Desert,Egypt, Egyptian Geophysical Society, 2003.
Mallick et al., An innovative technique resolves apparent anomalies in detection of gas zones based on neutron-density logs1997.
Doveton et al., Borehole petrophysical chemostratigraphy of Pennsylvanian black shales in the Kansas subsurface, Kansas Geological Survey, University of Kansas 2004.
Vaughn et al., Litho-flow facies prediction in an alluvial fan/fluvial system, Central North Sea, 1999.

* cited by examiner

SYSTEM AND METHOD FOR SWEET ZONE IDENTIFICATION IN SHALE GAS RESERVOIRS

FIELD OF THE INVENTION

The present invention relates generally to methods and systems for identification of the sweet zone in shale gas reservoirs and more particularly to combining types of well log information to identify the sweet zone.

BACKGROUND OF THE INVENTION

Quick identification of the kerogen-rich sweet zone in wells, mapping the sweet zone areas, and placement of the horizontal holes within the sweet zone is one of the most important tasks in shale gas exploration and development. As shale gas plays have become more important to the oil and gas industry, methods of identifying kerogen-rich zones have gained in importance. In many cases, the existing methods are applicable only to the specific formation in which they have been applied, and do not have general relevance to new areas of exploration and development.

SUMMARY OF THE INVENTION

According to one implementation of the present invention, a computer implemented method for automatically identifying a hydrocarbon (such as kerogen, gas, oil) rich zone in a well bore includes obtaining well log data including neutron data, density data, radioactivity data, and resistivity data representative of physical characteristics of a formation surrounding the well bore and computing an apparent neutron porosity and an apparent density porosity based on the neutron data and density data. A normalized neutron-density separation is computed based on the computed apparent neutron porosity and the computed apparent density porosity and a baseline of normal shale is determined for each data type. Using the computed normalized neutron-density separation, the radioactivity data, the resistivity data, and the determined baselines, the presence or absence of a hydrocarbon rich zone is determined. A quality index may further be derived from the data. The computation of the presence or absence of a hydrocarbon rich zone and quality index is done at each depth level logged in the well.

In an embodiment, a computer system for automatically identifying a hydrocarbon rich zone in a well bore includes a computer readable medium having computer readable well log data stored thereon, the well log data including neutron data, density data, radioactivity data, and resistivity data representative of physical characteristics of a formation surrounding the well bore. A processor of the computer system is configured and arranged to compute an apparent neutron porosity and an apparent density porosity based on the neutron data and density data, to compute a normalized neutron-density separation based on the computed apparent neutron porosity and the computed apparent density porosity, to compute a baseline of normal shale for the neutron data, density data, radioactivity data and resistivity data, and to compute the presence or absence of a hydrocarbon rich zone based on the computed normalized neutron-density separation, the radioactivity data, the resistivity data, and the determined baselines. The computations outlined above are done at each depth level logged in the well.

The above summary section is provided to introduce a selection of concepts in a simplified form that are further described below in the detailed description section. The summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

These and other features of the present invention will become better understood with regard to the following description, pending claims and accompanying drawings where:

DETAILED DESCRIPTION OF THE INVENTION

It is useful to evaluate subterranean formations to determine whether they are likely to contain significant amounts of organic matter, and therefore act as a good source of hydrocarbon resources. One method of characterizing a formation is to make measurements of characteristics along a borehole penetrating the formation, either during or after drilling operations, i.e., well logging. Well logging includes a number of techniques including resistivity/conductivity measurements, ultrasound, NMR, neutron, density, uranium concentration and radiation scattering, for example. Borehole data of this type is often used to replace or supplement the collection of cores for direct inspection. Conventionally, logged borehole data is analyzed by human interpreters in order to characterize a subsurface geological formation to allow decisions to be made regarding potential of the well or to determine information about the nature of the surrounding geologic area.

The inventors have determined that by combining information from a variety of well logs, a quantitative approach may be pursued to identify formations or portions of formations that are likely to be rich in organic material and therefore likely to offer potential in hydrocarbon production, without requiring human interpretation.

Figure 1:
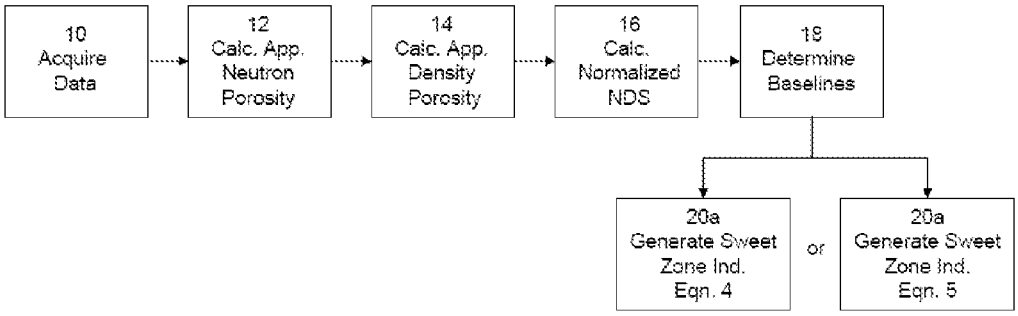
FIG. 1 is a flowchart illustrating a method in accordance with an embodiment of the invention.

In this regard, a method in accordance with the present invention is illustrated in the flowchart of FIG. 1. At step 10, well log data is obtained. In an embodiment, the well log data comprises neutron, density, uranium concentration and resistivity data. In another embodiment, uranium concentration is replaced by gamma ray data, each being a type of radioactivity data. As will be appreciated, the well log data may be acquired by any of a variety of well logging techniques, or may be existing well log data stored locally or remotely from a computer system on which the method is executed. In a particular example and not by way of limitation, the well log data may be from a shale formation.

From the density well log data, an apparent density porosity (PHIT_D) is calculated in step 14. In this regard, Equation 1 sets out the calculation for PHIT_D:

$$PHIT_D=\min(\max(((\rho_M-\rho_B)/(\rho_M-\rho_F)),0.0),1.0) \quad \text{Eqn. 1}$$

With respect to Equation 1, $\rho_M$ is the density of the rock matrix (where the matrix is selected to be a calcite matrix or other appropriate matrix, depending on the geology of the shale formation), $\rho_B$ is the bulk density of the rock, and $\rho_F$ is the density of fluid in the rock (where the fluid may be selected to be water). As will be appreciated, this Equation will produce a value of 0.0 where the ratio $(\rho_M-\rho_B)/(\rho_M-\rho_F)$ is negative, 1.0 when the ratio is greater than one, and the value of the ratio where the ratio is between zero and one. That is, it calculates a porosity value that is bounded by zero and one.

At step 12, an apparent neutron porosity (PHIT_N) is calculated in accordance with Equation 2:

$$PHIT_N=\min(\max(((TNPH-TNPM)/(TNPF-TNPM)),0.0),1.0) \quad \text{Eqn. 2}$$

In Equation 2, TMPH is the neutron porosity reading of the rock, TNPM is the neutron porosity of the matrix and TNPF is the neutron porosity of the fluid. Similarly to Equation 1, this Equation produces a value equal to the ratio (TNPH−TNPM)/(TNPF−TNPM) for values between zero and one, and is bounded by zero and one for all other values of the ratio.

Using the results of Equations 1 and 2, a value for normalized neutron-density separation (VWSH_NDS) may be calculated (step 16) in accordance with Equation 3:

$$VWSH_NDS=\max(\min([(PHIT_N-PHIT_D)-(PHIT_N-PHIT_D)_{min}]/[(PHIT_N-PHIT_D)_{ns}-(PHIT_N-PHIT_D)_{min}],1.0),-1.0) \quad \text{Eqn. 3}$$

In Equation 3, the newly introduced quantity $(PHIT_N-PHIT_D)_{ns}$ is the neutron-density separation for normal shales, while $(PHIT_N-PHIT_D)_{min}$ represents a minimum value of the neutron-density separation. In an embodiment, $(PHIT_N-PHIT_D)_{min}$ is taken to be zero and that portion of the numerator and denominator is eliminated. This equation produces values between minus one and one, although in most cases the values are between zero and one.

At step 18, a baseline value for each of the quantities is determined. For an embodiment using neutron, density, uranium concentration and resistivity data, baselines are determined for each of these. For embodiments in which gamma ray data replaces uranium concentration data, a baseline for gamma ray log readings is determined.

At step 20*a*, the values determined in the preceding steps are used to generate a sweet zone indicator (RNR) in accordance with the if statement in Equation 4.

$$RNR=1 \text{ if } (VWSH_NDS<VWSH_NDS_NSBSL\cdot FVBSL \text{ and } URAN>URAN_NSBSL\cdot FUBSL \text{ and } RD>RD_NSBSL\cdot FRBSL) \text{ else } RNR=0 \quad \text{Eqn. 4}$$

In Equation 4, by way of example and not limitation, VWSH_NDS_NSBSL is the normalized neutron-density separation baseline for normal shales, URAN is a uranium concentration, URAN_NSBSL is baseline uranium concentration for normal shales, RD is a resistivity value of the log data, RD_NSBSL is a baseline resistivity for normal shales and, FVBSL, FUBSL and FRBSL are adjustment factors for the respective baselines. Thus, if neutron-density separation is less than an adjusted baseline, and uranium and resistivity are above their respective adjusted baselines, then the indicator takes the value one, otherwise it takes the value zero.

As will be appreciated, the baseline for each type of log may be a constant, or may vary with depth and thus be represented by a curve or trendline, depending on the geological or borehole conditions. Typically, a shale interval is chosen to determine the baseline value or curve. The respective adjustment factors, FVBSL, FUBSL and FRBSL are selected to reduce measurement noise and also to reduce high frequency variations in the actual geological structure, thereby improving reliability of the indicator. In an embodiment, these are determined by Monte Carlo experimentation. The adjustment factors may also be adjusted in accordance with the experience of a user based on local geological conditions, analogues, and data quality and/or data provenance.

In alternate step 20*b*, for the case where uranium logs are replaced with gamma ray logs, Equation 4 is replaced by Equation 5.

$$RNR=1 \text{ if } (VWSH_NDS<VWSH_NDS_NSBSL\cdot FVBSL \text{ and } GR>GR_NSBSL\cdot FGBSL \text{ and } RD>RD_NSBSL\cdot FRBSL) \text{ else } RNR=0 \quad \text{Eqn. 5}$$

The newly introduced quantities in Equation 5 are GR, which indicates gamma ray data, GR_NSBSL which is the gamma ray baseline for normal shale and FGBSL, the adjustment factor for the gamma ray baseline. That is, for Equation 5, gamma ray data replaces the uranium data of Equation 4, but the equations otherwise operate in accordance with common principles.

In general, the adjustment factors are selected to be close to one, and in an embodiment are limited to a range between 0.5 and 1.5. In a particular embodiment, (VSBSL, FUBSL, FRBSL, FGBSL)=(0.6, 0.99, 0.99, 0.99).

As will be appreciated, steps 12 and 14 could be performed in any order. Likewise, the baseline determination for each type of well log performed in step 18 could, in principle, be performed in advance of any of the other calculations, and after all calculations except those of step 20, which depend on the results of step 18.

Evaluation of either Equation 4 or 5 will return a value of one or zero, indicating presence or absence of a sweet zone respectively. The indicator may then be used as a basis for determining a depth to initiate a horizontal drilling operation, or otherwise to guide production drilling decisions.

Figure 2:
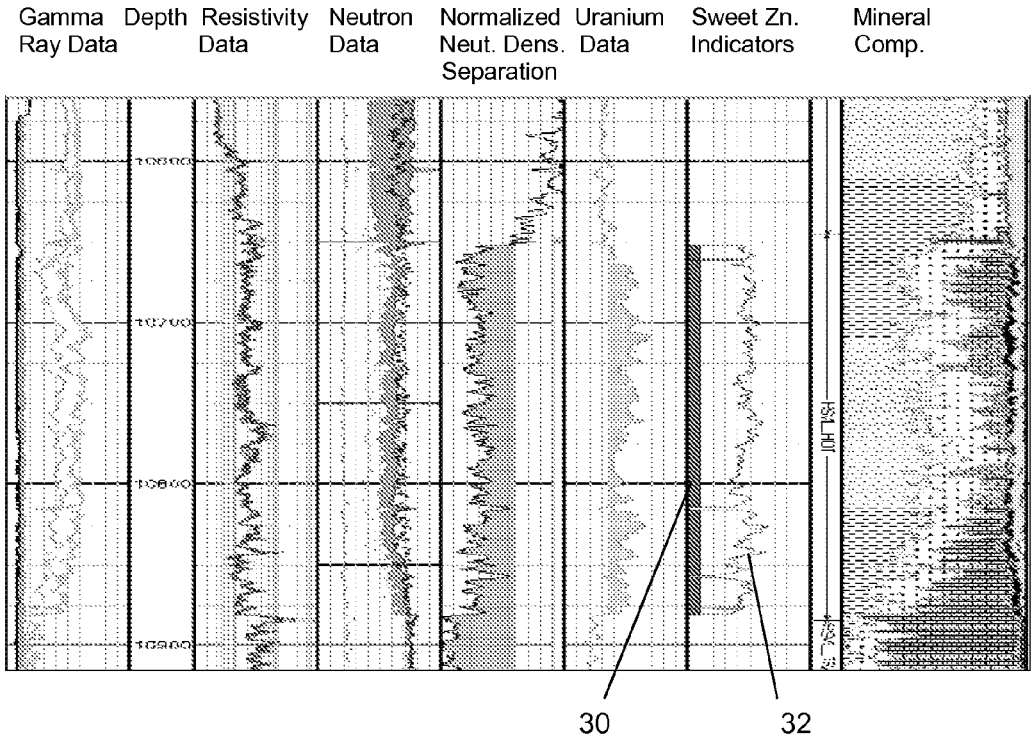
FIG. 2 is an example of a set of well logs showing a determined sweet zone indicator and sweet zone quality index in accordance with an embodiment of the invention.

FIG. 2 illustrates a number of well logs and derivative products in accordance with an embodiment of the invention. The first column shows radiation data derived from gamma ray measurements. The space between the two curves in the central portion of the log is indicative of uranium and represents a difference between spectral gamma radiation (the right hand curve) and computed gamma radiation (left hand curve). Some additional curves along the left-hand side of the trace are not relevant to the method described herein.

The second column shows depth of the well. The third column shows resistivity data for a number of different depths of investigation. The fourth column shows neutron and density data and the fifth shows uranium data.

In an embodiment, the indicator may be supplemented with a quality index that quantifies the quality of the identified sweet zone. This is illustrated in FIG. 2, in the sixth column where 30 indicates a region in which the sweet zone indicator is one and 32 is a curve indicating the quality index within the zone 30.

As will be appreciated, in accordance with Equation 4, above, the region 30 corresponds to the shaded region in column 5 where normalized neutron-density separation is less than its baseline and the intersection of that shaded region with the shaded region in column 6 where uranium concentration is above its respective baseline. In the illustrated example, resistivity is above its baseline substantially throughout the region in which normalized neutron-density separation is less than its baseline.

In an embodiment, a sweet zone quality index may be calculated based on the data used to determine the sweet zone indicator. In particular, quality indexes are calculated for each of the data types, then those calculated quality indexes are used to compute an overall quality index that allows for comparison between or among various formations.

$$SQI_NDS=\min(\max([VWSH_NDS_NSBSL-VWSH_NDS]/[VWSH_NDS_NSBSL-VWSH_NDS_{min}],0),2) \quad \text{Eqn. 6}$$

$$SQI_URAN=\min(\max(([URAN-URAN_NSBSL]/[URAN_{max}-URAN_NSBSL]),0),1) \quad \text{Eqn. 7}$$

$$SQI_GR=\min(\max([GR-GR_NSBSL]/[GR_{max}-GR_NSBSL],0),1) \quad \text{Eqn. 8}$$

$$SQI_RD=\min(\max([\log_{10}(RD)-\log_{10}(RD_NSBSL)]/[\log_{10}(RD_{max})-\log_{10}(RD_NSBSL)],0),1) \quad \text{Eqn. 9}$$

$$SQI=\min(\max([SQI_NDS\cdot(W_{nds}/W_{nds}W_{uran}+W_{rd}))+SQI_URAN\cdot(W_{uran}/(W_{nds}+W_{uran}+W_{rd}))+SQI_RD\cdot(W_{rd}/(W_{nds}+W_{uran}+W_{rd}))],0),1) \quad \text{Eqn. 10}$$

Or $$SQI=\min(\max([SQI_NDS\cdot(W_{nds}/W_{nds}+W_{gr}+W_{rd}))+SQI_GR\cdot(W_{gr}/(W_{nds}+W_{gr}+W_{rd}))+SQI_RD\cdot(W_{rd}/(W_{nds}+W_{gr}+W_{rd}))],0),1) \quad \text{Eqn. 11}$$

As will be appreciated, the choice between Equation 10 and 11 will depend on availability of uranium data. Where uranium data is not available, gamma ray data is used in accordance with Equation 11. Otherwise, Equation 10 is generally preferable. In Equations 10 and 11, the W quantities are respective weighting factors, and the default value is 1. The respective weighting factor has a subscript of nds when referring to the neutron-density separation data, uran when referring to the uranium data, gr when referring to the gamma ray data, and rd when referring to the resistivity data. An operator may elect to weight the quantities differently, based on the observed geological conditions, data quality and/or provenance, or other factors.

The newly introduced quantities in Equations 6 through 11 are various measures of the sweet zone quality index based on individual well logs and normalizing constants. In Equation 6, SQI_NDS refers to the sweet zone quality index from the neutron-density separation data, and $VWSH_NDS_{min}$ is the minimum value of VWSH_NDS_NSBSL (with a default of zero). In Equation 7, SWI_URAN refers to the sweet zone quality index from the uranium concentration data, and $URAN_{max}$ refers to the maximum of the uranium concentration data (default value of 10 in ppm). In Equation 8, SQI_GR refers to the sweet zone quality index from gamma ray data, and $GR_{max}$ refers to the maximum of the gamma ray data (default value of 200 in API units). In Equation 9, SQI_RD refers to the sweet zone quality index from resistivity data, and $RD_{max}$ refers to the maximum of the resistivity data (default value of 100 in ohm-meter units). In Equations 10 and 11, SQI refers to the sweet gas quality index which is a combination of previous determined parameters from Equations 6 and 9, and either Equation 7 or Equation 8 depending on whether uranium concentration data is available.

In an embodiment, the foregoing methods may be implemented in a computer system and computer executable instructions for performing the method may be stored on a tangible computer readable medium.

Figure 3:
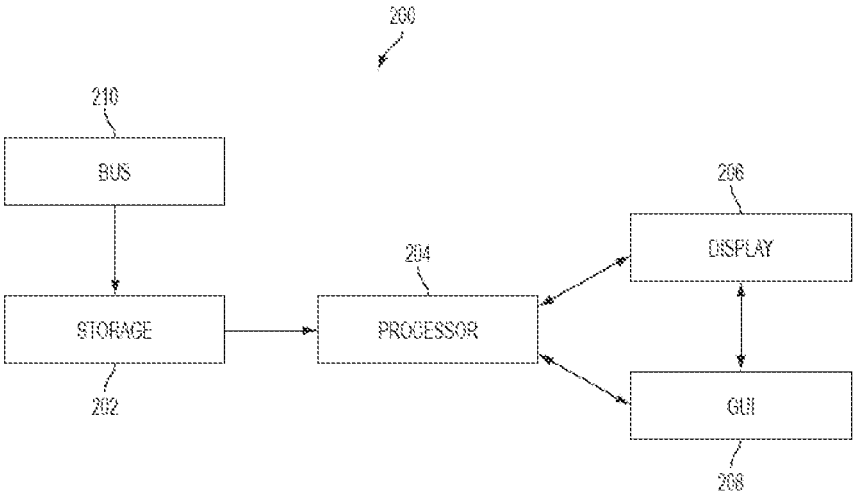
FIG. 3 schematically illustrates a system for performing a method in accordance with an embodiment of the invention.

A system 200 for performing the method is schematically illustrated in FIG. 3. The system includes a data storage device or memory 202. The stored data may be made available to a processor 204, such as a programmable general purpose computer. The processor 204 may include interface components such as a display 206 and a graphical user interface 208, and is used to implement the above-described transforms in accordance with embodiments of the invention. The graphical user interface may be used both to display data and processed data products and to allow the user to select among options for implementing aspects of the method. Data may be transferred to the system 200 via a bus 210 either directly from a data acquisition device, or from an intermediate storage or processing facility (not shown).

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention. In addition, it should be appreciated that structural features or method steps shown or described in any one embodiment herein can be used in other embodiments as well.

What is claimed is:

1. A computer implemented method of automatically identifying a hydrocarbon rich zone in a well bore, comprising:

obtaining well log data comprising neutron data, density data, radioactivity data, and resistivity data representative of physical characteristics of a formation surrounding the well bore;

computing, via a computer processor, an apparent neutron porosity and an apparent density porosity based on the neutron data and density data;

computing, via the computer processor, a normalized neutron-density separation based on the computed apparent neutron porosity and the computed apparent density porosity;

determining individual baselines of the formation for each of the neutron data, density data, radioactivity data and resistivity data;

using, via the computer processor, the computed normalized neutron-density separation, the radioactivity data, the resistivity data, and the determined baselines to determine the presence or absence of a hydrocarbon rich zone.

2. A method as in claim 1, wherein the radioactivity data is selected from the group consisting of uranium log data and gamma ray data.

3. A method as in claim 2, wherein, if uranium log data is available, it is preferentially selected over gamma ray data for use as the radioactivity data and if uranium log data is unavailable, gamma ray data is used as the radioactivity data.

4. A method as in claim 1, wherein the using the computed normalized neutron-density separation, the radioactivity data, and the resistivity data to determine the presence or absence of a hydrocarbon rich zone comprises comparing each to a respective baseline and, based on the comparison, determining the presence or absence of the hydrocarbon rich zone.

5. A method as in claim 4, wherein the comparing comprises determining whether normalized neutron-density separation is less than its respective baseline, whether the radioactivity data is greater than its respective baseline and whether the resistivity data is greater than its respective baseline, such that when all three conditions are true, a hydrocarbon rich zone is determined to be present.

6. A method as in claim 4, wherein prior to the comparing, each of the respective baselines is multiplied by a respective adjustment factor.

7. A method as in claim 6, wherein each of the respective correction factors is between 0.5 and 1.5.

8. A method as in claim 1, further comprising, visually displaying an indicator of the presence or absence of a hydrocarbon rich zone.

9. A method as in claim 1, further comprising determining a sweet zone quality index by:

determining a respective quality index for each of the normalized neutron-density separation, the radioactivity data and the resistivity data; and determining the sweet zone quality index by performing a weighted averaging of the respective quality indexes.

10. A method as in claim 1, wherein the formation comprises a shale gas reservoir.

11. A system configured and arranged to automatically identify a hydrocarbon rich zone in a well bore, comprising:

a computer readable medium having computer readable well log data stored thereon, the well log data comprising neutron data, density data, radioactivity data, and resistivity data representative of physical characteristics of a formation surrounding the well bore;

a processor, configured and arranged to:

compute an apparent neutron porosity and an apparent density porosity based on the neutron and density data;

compute a normalized neutron-density separation based on the computed apparent neutron porosity and the computed apparent density porosity;

compute individual baselines of the formation for each of the neutron, density, radioactivity and resistivity; and compute the presence or absence of a hydrocarbon rich zone based on the computed normalized neutron-density separation, the radioactivity data, the resistivity data, and the determined baselines.

12. A system as in claim 11, further comprising a display, configured and arranged to produce a visual display of an indicator of the computed presence or absence of a hydrocarbon rich zone.

13. A system as in claim 11, wherein the processor is further configured and arranged to select uranium log data as the radioactivity data when uranium log data is available, or to select gamma ray data as the radioactivity data when uranium log data is unavailable.

* * * * *